United States Patent [19]

Lundquist

[11] 4,126,074

[45] Nov. 21, 1978

[54] VIOLIN HARP

[76] Inventor: Eric G. Lundquist, 2340 22nd St., Rockford, Ill. 61108

[21] Appl. No.: 884,859

[22] Filed: Mar. 9, 1978

Related U.S. Application Data

[63] Continuation-in-part of Ser. No. 704,060, Jul. 9, 1976, abandoned.

[51] Int. Cl.[2] ..... G10D 1/12; G10D 3/12

[52] U.S. Cl. ..... 84/313; 84/285; 84/297 R

[58] Field of Search ..... 84/173, 267, 284–290, 84/292, 297 R, 298, 307, 312, 313, 316

[56] References Cited

U.S. PATENT DOCUMENTS

| | | | |
|---|---|---|---|
| 915,293 | 3/1909 | Herrling | 84/297 R X |
| 1,210,015 | 12/1916 | Strandberg et al. | 84/312 R X |
| 2,619,864 | 12/1952 | Nixon | 84/292 X |

FOREIGN PATENT DOCUMENTS

| | | | |
|---|---|---|---|
| 128,112 | 2/1902 | Fed. Rep. of Germany | 84/316 |
| 218,102 | 11/1941 | Switzerland | 84/285 |

*Primary Examiner*—Lawrence R. Franklin
*Attorney, Agent, or Firm*—Peter E. Heuser

[57] ABSTRACT

A stringed musical instrument is disclosed which includes a body, a first bridge transversely mounted to the body adjacent one end thereof, and a second bridge mounted to the body in the vicinity of the opposite end. First and second string mounting means are positioned longitudinally outward of the first and second bridges, respectively, which tautly suspend a plurality of strings between said bridges. Lever means are provided for raising and lowering at least one of the strings at said first bridge to raise and lower the pitch of the strings.

5 Claims, 3 Drawing Figures

VIOLIN HARP

BACKGROUND OF THE INVENTION

This application is a continuation-in-part of my application Ser. No. 704,060, filed July 9, 1976, now abandoned.

The present invention relates to stringed musical instruments. More particularly the invention relates to a violin harp with a vibrato lever built therein.

Many different types of stringed instruments have been designed and marketed. A number of these have been very successful in producing the beautiful music desired by musicians and their audiences. Several disadvantages have, however, become evident with conventional designs. String slippage has been an ever present problem which requires regular tuning of most instruments. Very few instruments have any versatility at all, e.g., can be hand-held as a violin or played on a table top as an autoharp. Another difficulty which has confronted musicians, especially those who play instruments which are set on a surface to be played, is the production of vibrato without dampening the vibration of the strings. Perhaps the most evident problem is the difficulty in learning to play almost any stringed instrument. This problem is most notable when the playing of chords is attempted.

Accordingly, a primary object of this invention is to provide a stringed musical instrument which reduces string slippage. Another object is an instrument which can be both hand-held and played on a table top. Yet another object is the provision of an instrument with a vibrato mechanism which can be used without dampening the vibration of the strings. Yet another object is the provision of a string instrument which may be played by those who do not have the time or the ability to learn how to play conventional instruments.

SUMMARY OF THE INVENTION

The present invention responds to the problems presented in the prior art by providing a stringed musical instrument which includes lever means for raising and lowering at least one of the strings at one of the bridges, thereby providing means for imparting a vibrato effect to the strings. In one embodiment this means includes a flanged portion which extends between the bridge and the string so that the string tension can be varied by changing the angular position of the lever means.

The novel features which are believed to be characteristic of the invention are set forth in the appended claims. It is believed the invention will be best understood by reference to the following description taken in connection with the accompanying drawings, in which:

DETAILED DESCRIPTION OF THE PREFERRED EMBODIMENTS

Figure 1:
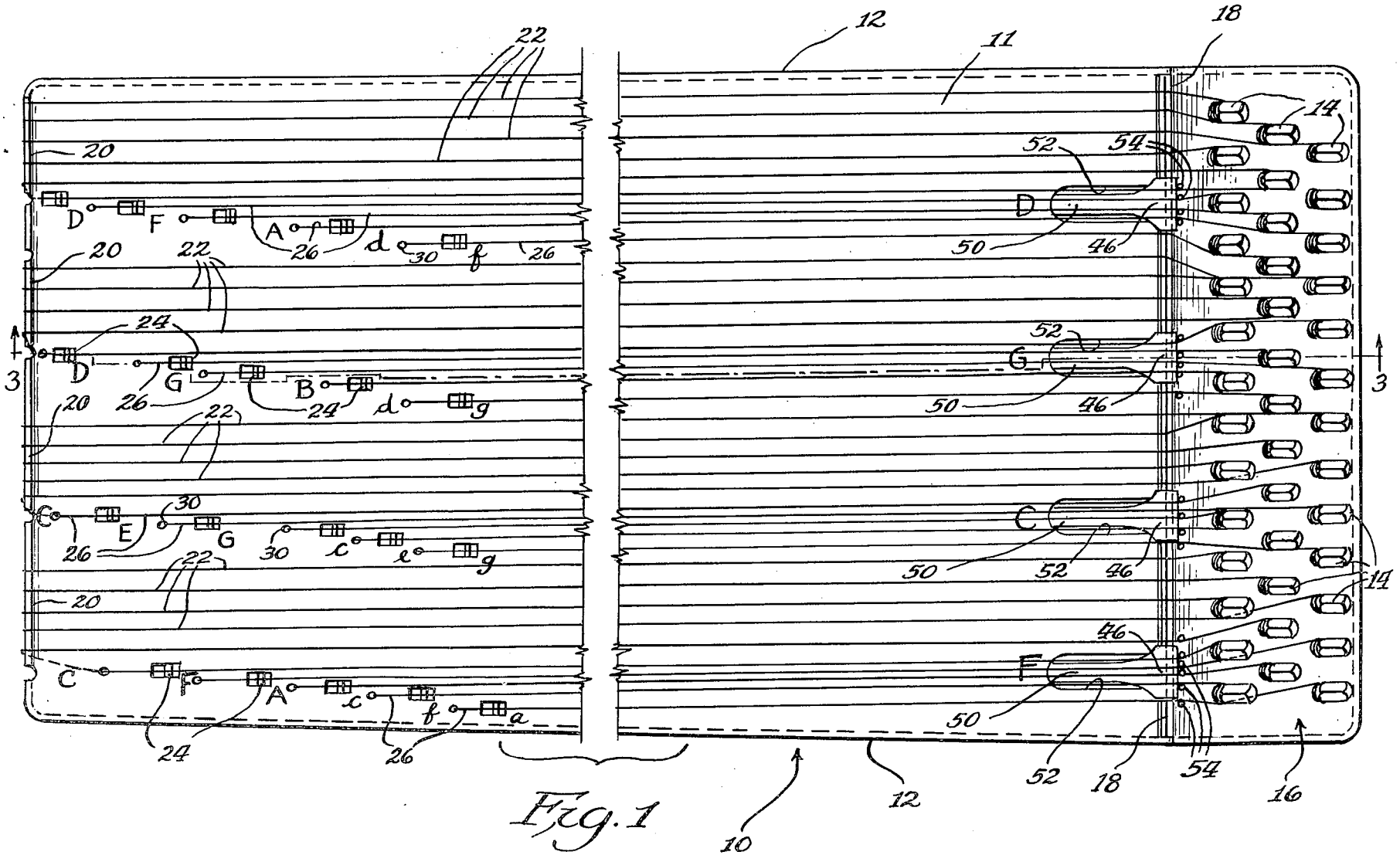
FIG. 1 is a plan view of the top of the violin harp.
Figure 2:
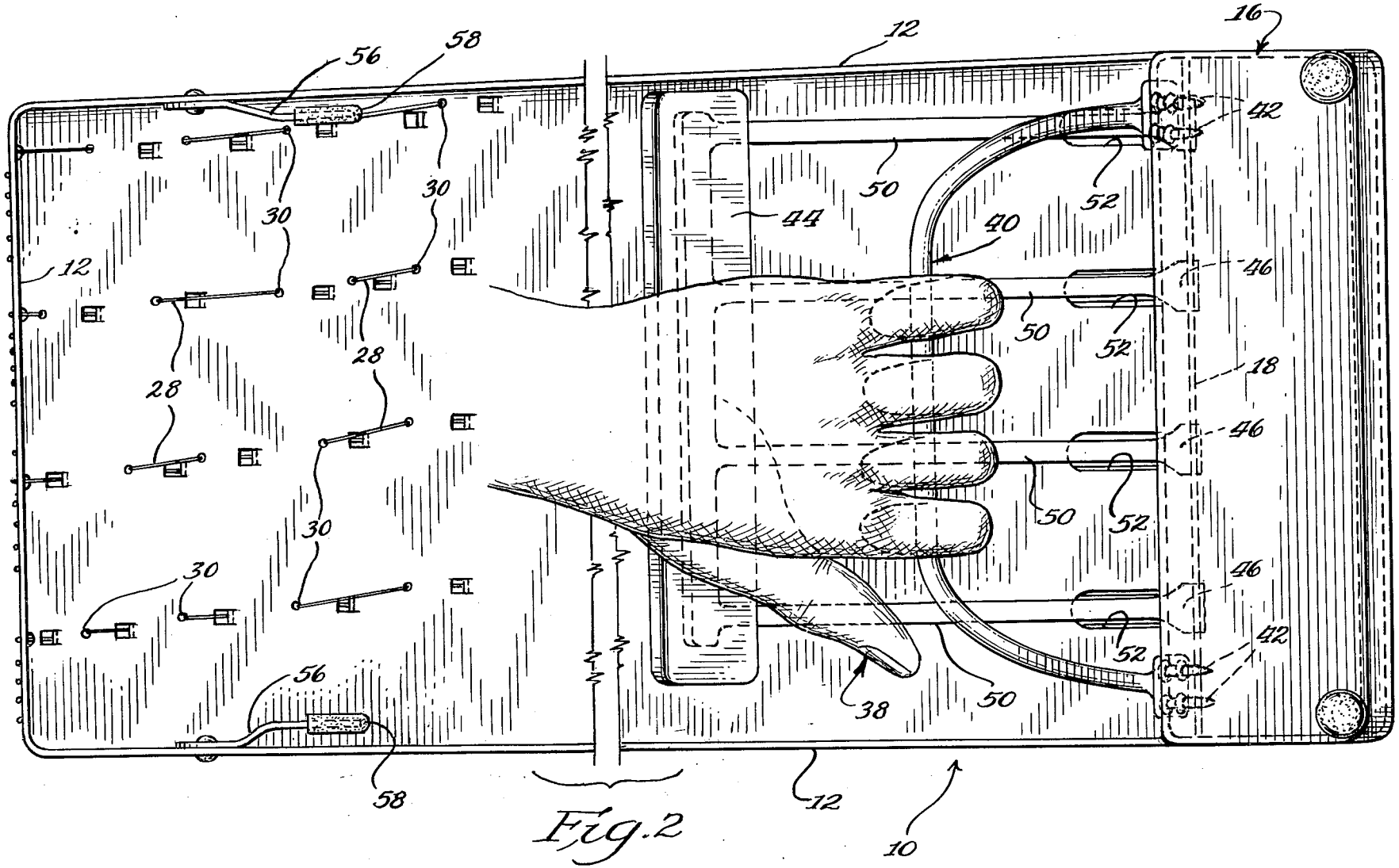
FIG. 2 is a view of the underside of the violin harp.

Referring now to the drawings, the violin harp is indicated generally at 10. The body 11 or sound board of the harp is formed of a resonant, preferably metallic, material. Resonance plates 12 partially enclose the underside of the body to improve the resonance of the instrument. In the illustrated harp the resonance plates

12 are formed of the downwardly bent edges of the body.

String mounting means are provided at each end of the body 11. Such means comprise tuning pins 14 at one end, which are threaded into the tuning block 16. These tuning pins desirably have squared tops so that the instrument may be finely tuned with a suitable wrench. The other ends of the strings are mounted to the body 11 by two different methods in the illustrated embodiment. The bass strings 22 are knotted at 32, and are retained in position by openings 34 in the end resonant plate. These openings 34 allow the string or wire 22 but not the knot 32 to fit therethrough. The bass strings extend across first and second transverse bridges 18 and 20 on opposite ends of the body 11 which act to elevate the strings as in conventional instruments.

A plurality of raised lips 24 provide the second bridge for the melody or chord strings 26. The mounting means for this end of the melody/chord strings consist of apertures 30 in the body 11, through which these strings are looped. Thus, a single string extends from one tuning pin 14, across the body 11 to the vicinity of the opposite end of the body, and then back to a second tuning pin. The difference in tone between the halves of the melody/chord strings results from the fact that each string half has a different effective length. That is, the distance between the first bridge 18 and the raised lip 24 for one of the halves is different from the corresponding distance for the other half of the string. Despite the fact that a single string is doubled back across the body, it has been found that to a limited degree, each note can be individually tuned via its tuning pin. Since the reversal of string direction at apertures 30 is so sharp, there will be no slippage unless there is a substantial difference in the tension of the string on either side of the apertures. Such a difference should not be necessary if the raised lips 24 are properly situated in the instrument body.

Each string 22 or 26 preferably comprises wire, but may be gut or any other conventional material. The bass strings 22 may include tight coils wrapped around each string (not shown) to provide a lower tone.

In the instrument depicted in FIG. 1, the strings are arranged so that it is much easier for a novice to play because the notes of a chord are grouped together. For example, chords in the key of F would include the notes F, A and C which are grouped together on the instrument. Similarly chords in the key of C would include the notes C, E and G. D, G and B are grouped together for the key of G, and F, A and D are adjacent for chords in the key of D. Other keys such as A, E and B may also be provided. The illustrated instrument has two octaves of each of these notes.

The notes of a diatonic scale may be played by moving from left to right on the sound board, among the various chord groups. While this may be more difficult than moving from one string to the next adjacent one, it is more important that the user have less difficulty in playing a tune. This is easier in the present invention since to play a chord one need only strum a string grouping. In playing a tune if the user accidentally hits an adjacent string in addition to the intended string, the second note will harmonize with the first. For the convenience of the user the notes are designated on the sound board, with the higher octave being in minor case letters.

Hand-operated lever means 36 are provided to enable the user to rapidly vary the tension in the strings while the instrument is being played. By varying the tension, the pitch of the strings is changed so by rapidly moving the lever, a vibrato may be effected. Alternatively, the lever may be used to change the key of the strings being played.

In the illustrated embodiment the lever means 36 includes four lever arms 50, each of which has a flange 46 which contacts at least one string. Four strings are contacted by each flange 46 in the depicted embodiment. Locating pins 54, mounted in the tuning block 16, assure the proper positioning of these strings. Each lever arm 50 pivots on a fulcrum 48 which is positioned longitudinally outward of the first bridge or, in the depicted embodiment, between the first bridge 18 and the tuning pins 14. As shown in the depicted embodiment, and fulcrums of the lever arms should be aligend. Each lever arm extends across the first bridge 18 in contact with the underside of the desired strings, downward through slots 52 in the body 11 to facilitate operation by the user at a point therebelow. A connecting bar 44 extends between the lever arms ends, to further simplify operation. String tension causes the bar 44 to naturally bias against the musician's hand. A strap 40 is provided which is substantially parallel to the connecting bar 44. The user may thus insert his fingers through the strap so that the lever means is operable by the heel of his hand.

Figure 3:
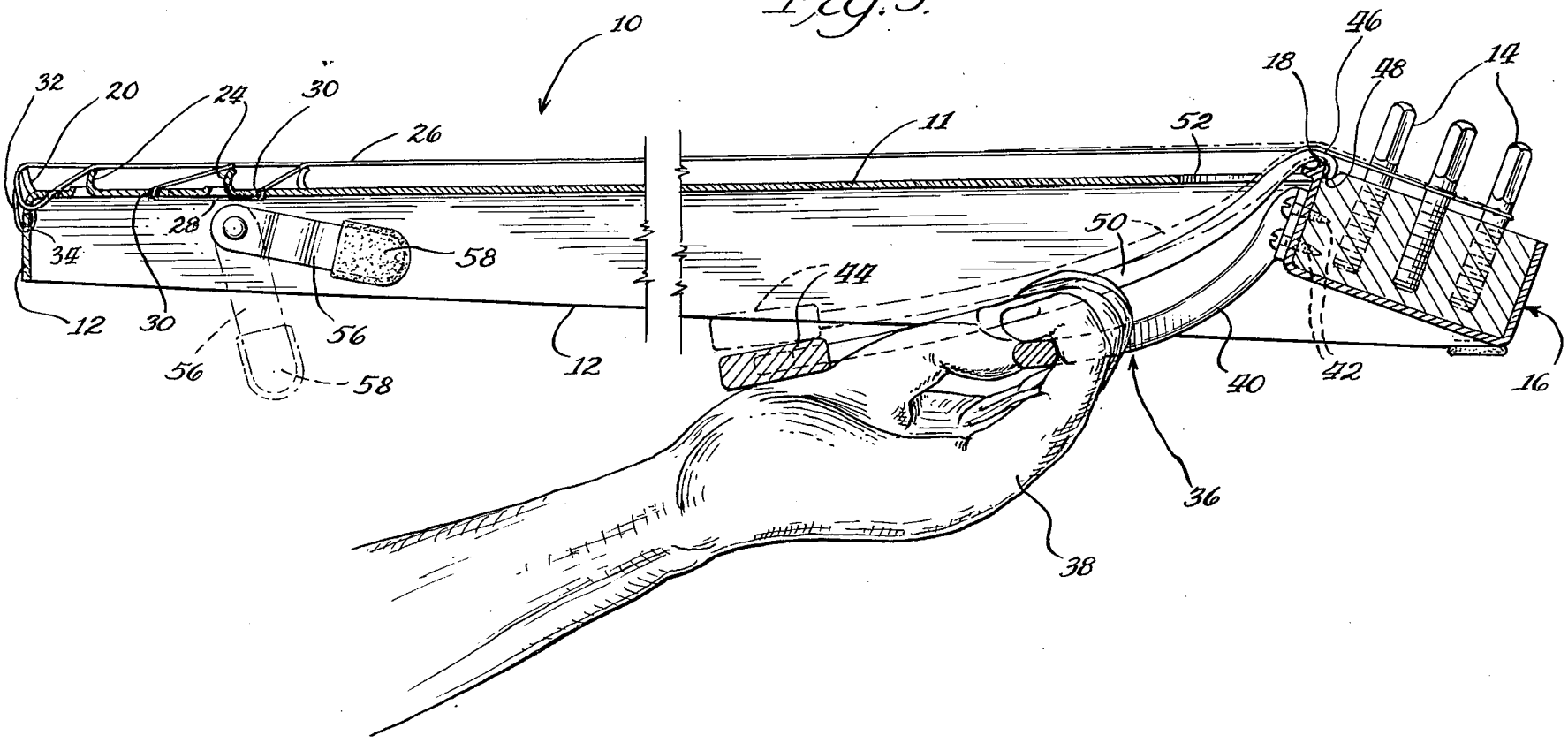
FIG. 3 is a sectional view taken along line 3—3 of FIG. 1.

Retractable legs 56 with pads 58 thereon may be provided so that the harp may be placed on a tabletop and played. The legs 56 are lowered to the position shown by dotted lines in FIG. 3 so that the harp will balance on the bar 44 and the two legs. The position of the legs 56 may be infinitely adjusted to vary the pressure of the bar 44. An inherent spring effect is present when the lever arm flanges 46 press against the taut strings 26 so when the harp 10 is placed on a table and plucked or strummed, the body 11 of the harp will vibrate up and down causing a desirable vibrato effect.

Of course, it should be understood that various changes and modifications in the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A musical instrument comprising:

a body;

a first bridge transversely mounted to one end of said body;

a second bridge mounted to the opposite end of said body;

first and second string mounting means positioned outward of said first and second bridges, respectively;

a plurality of strings tautly suspended between said bridges by said mounting means, said second string mounting means comprising two openings in said body, through which at least one of said strings is looped so that a single string can double back to form adjacent notes on said instrument; and lever means for varying the tension of said strings while the instrument is being played, said lever means including a flanged portion which extends between said first bridge and at least one of said strings so that the tension in at least one of said strings can be varied by changing the angular position of said lever means.

2. In a musical instrument of the type including a body, a first bridge transversely mounted to one end of said body, a second bridge mounted to the opposite end of said body, first and second string mounting means positioned outward of said first and second bridges, respectively, a plurality of strings tautly suspended between said bridges by said mounting means, and means for rapidly and repeatedly varying the tension of said strings while the instrument is being played, the improvement comprising:

a plurality of aligned slots in said body; and lever means comprised of a plurality of lever arms, each of said lever arms including a flanged portion which is positioned between said first bridge and at least one of said strings, said lever arms extending from aligned fulcrum points, across said first bridge and downward through said body slots to aligned positions below said body, so that the tension in at least some of said strings can be varied by changing the angular position of said lever arms.

3. The musical instrument of claim 2 wherein said fulcrum points are positioned substantially between said first bridge and said first string mounting means.

4. The musical instrument of claim 2 wherein said lever means further comprise a connecting bar extending between the lever arm ends remote from said fulcrums, said connecting bar being substantially parallel to said body.

5. The musical instrument of claim 4 further comprising a strap mounted to the underside of said body substantially parallel to said connecting bar to enable the musician to hold the instrument at said strap and to operate said lever arm connecting bar with the same hand.

* * * * *